US012082699B2

(12) United States Patent
Zeng

(10) Patent No.: US 12,082,699 B2
(45) Date of Patent: Sep. 10, 2024

(54) FOLDABLE ULTRA-THIN BED

(71) Applicant: Guohong Zeng, Qingyuan (CN)

(72) Inventor: Guohong Zeng, Qingyuan (CN)

( * ) Notice: Subject to any disclaimer, the term of this patent is extended or adjusted under 35 U.S.C. 154(b) by 0 days.

(21) Appl. No.: 17/646,000

(22) Filed: Dec. 27, 2021

(65) Prior Publication Data

US 2022/0117400 A1 Apr. 21, 2022

(30) Foreign Application Priority Data

Nov. 2, 2021 (CN) ..... 202111288338.8

(51) Int. Cl.
*A47C 19/12* (2006.01)
*A47C 20/04* (2006.01)

(52) U.S. Cl.
CPC ..... *A47C 19/12* (2013.01); *A47C 20/041* (2013.01)

(58) Field of Classification Search
CPC ..... A47C 19/12; A47C 20/041; A47C 19/122
USPC ..... 5/37.1
See application file for complete search history.

(56) References Cited

U.S. PATENT DOCUMENTS

| | | | | |
|---|---|---|---|---|
| 10,463,163 | B1 * | 11/2019 | Aramli | A47C 21/026 |
| 2009/0139026 | A1 | 6/2009 | Chen | |
| 2009/0249545 | A1 | 10/2009 | Lee | |
| 2014/0366267 | A1 * | 12/2014 | Suh | A47C 20/041 5/174 |
| 2018/0014654 | A1 | 1/2018 | Yang | |
| 2020/0054145 | A1 * | 2/2020 | Shih | A47C 23/005 |
| 2020/0054148 | A1 * | 2/2020 | Zeng | A47C 19/005 |
| 2020/0154888 | A1 * | 5/2020 | Brown | A47C 20/041 |
| 2020/0187662 | A1 * | 6/2020 | Zeng | A47C 19/122 |
| 2020/0237105 | A1 * | 7/2020 | Eskridge, III | A47C 27/14 |
| 2020/0375368 | A1 * | 12/2020 | Choi | A47C 20/04 |
| 2021/0007502 | A1 * | 1/2021 | Zeng | A47C 21/006 |
| 2021/0259432 | A1 * | 8/2021 | Wang | A47C 20/12 |
| 2021/0321785 | A1 * | 10/2021 | Wang | A47C 21/00 |
| 2021/0346219 | A1 * | 11/2021 | Shih | A61G 7/015 |
| 2021/0378411 | A1 * | 12/2021 | Xie | A47C 20/041 |
| 2021/0393040 | A1 * | 12/2021 | Sun | A47C 19/025 |
| 2022/0022659 | A1 * | 1/2022 | Chung | A47C 20/041 |
| 2022/0061542 | A1 * | 3/2022 | Bishop | A47C 20/041 |
| 2022/0079349 | A1 * | 3/2022 | Huang | A47C 19/12 |
| 2022/0095802 | A1 * | 3/2022 | Chen | A47C 20/041 |
| 2022/0248862 | A1 * | 8/2022 | Liu | A47C 19/024 |
| 2022/0248863 | A1 * | 8/2022 | Shan | A47C 20/041 |
| 2022/0248864 | A1 * | 8/2022 | Shan | A47C 19/122 |
| 2022/0304476 | A1 * | 9/2022 | Liu | A47C 20/12 |

* cited by examiner

*Primary Examiner* — Justin C Mikowski
*Assistant Examiner* — Luke Hall
(74) *Attorney, Agent, or Firm* — Zhigang Ma

(57) ABSTRACT

A foldable ultra-thin bed includes bed frames. The number of bed frames is two. The two bed frames are provided in front and back. The left and right sides of the lower surface of the bed frame are fixedly connected with supporting legs. A folding mechanism is provided in the bed frame. One end of the folding mechanism is fixedly connected to a cross beam which is fixedly connected in a first U-shaped frame. Both ends of the first U-shaped frame are hinged to the folding mechanism. The folding mechanism is further provided with a supporting mechanism. The supporting mechanism, the folding mechanism and the first U-shaped frame are all covered with iron frame nets.

6 Claims, 4 Drawing Sheets

FOLDABLE ULTRA-THIN BED

TECHNICAL FIELD

The present disclosure relates to the technical field of ultra-thin beds, in particular to a foldable ultra-thin bed.

BACKGROUND

An ultra-thin bed is a small folding bed, which is convenient to use and carry, occupies a small space, and brings great convenience for people to live temporarily.

In the ultra-thin bed of the prior art, the vibrator is installed by cutting a slot on the iron net frame, then screwing it up with screws, and then tightening it with a cover (there are screws on the cover), so that the vibration effect on the bed body is poor, the vibration effect is unstable, and good comfort effect cannot be provided for people. At the same time, the existing ultra-thin bed is thick. The general ultra-thin bed carries a motor. When the bed is folded, the motor will bulge, which is not fully attached to the bed surface. The thickness after the bed is folded is often greater than 30 centimeters. After the bed is folded, the effect of being carried conveniently cannot be achieved, and the bed legs are usually fixed. If the bottom of the bed legs is worn, the bed legs cannot be replaced effectively, which will affect the use of the ultra-thin bed.

SUMMARY

Aiming at the shortcomings of the prior art, the present disclosure aims to provide a foldable ultra-thin bed, which has the characteristics of improving the vibration effect and facilitating the replacement of the bed legs.

To achieve the above purpose, the present disclosure provides the following technical scheme.

A foldable ultra-thin bed is provided, comprising bed frames, wherein the number of bed frames is two, the two bed frames are provided in front and back, the left and right sides of the lower surface of the bed frame are fixedly connected with supporting legs, a folding mechanism is provided in the bed frame, one end of the folding mechanism is fixedly connected to a cross beam which is fixedly connected in a first U-shaped frame, both ends of the first U-shaped frame are hinged to the folding mechanism, the folding mechanism is further provided with a supporting mechanism, and the supporting mechanism, the folding mechanism and the first U-shaped frame are all covered with iron frame nets.

By adopting the above technical scheme, the iron frame net can support the human body, and people can effectively lie on the ultra-thin bed.

Furthermore, the folding mechanism comprises a first cross beam and a second cross beam which are fixedly connected in the bed frame, the first cross beam and the second cross beam are fixedly connected through two connecting rods, the two connecting rods are fixedly connected to the left and right sides of the inner wall of the bed frame, respectively, the first cross beam is provided with a hinging element, and the hinging element is hinged with one end of the first U-shaped frame. The first cross beam and the second cross beam are fixedly connected by a strut, the folding mechanism is further connected with a lifting motor, one end of the lifting motor is hinged with a motor movable base, the motor movable base is fixedly connected to the strut, each of the two bed frames is provided with a motor movable base, respectively, one end of the lifting motor is hinged with the motor movable base, an accommodating groove for accommodating the lifting motor is provided in the bed frame, and when the lifting motor is completely placed in the accommodating groove, the motor movable base is attached to the iron frame net in parallel.

By adopting the above technical scheme, when the lifting motor works, the cross beam and the second U-shaped frame can be lifted, so that the angles of the cross beam and the second U-shaped frame can be effectively changed, which not only can achieve the folding effect, but also can change the lying posture of people, thus greatly facilitating the use of people.

Furthermore, the first U-shaped frame is fixedly connected with a reinforcing bar, a vibration mechanism is provided on the reinforcing bar, the vibration mechanism comprises an installing iron sheet, the installing iron sheet is fixedly installed at the lower side of the iron frame net by bolts, the lower surface of the installing iron sheet is fixedly connected with an installing rubber box, a sponge sleeve is fixedly connected in the installing rubber box, and a vibrator is sleeved in the sponge sleeve.

By adopting the above technical scheme, under the action of the wrapping of the sponge cover, the vibrator can achieve a more stable vibration effect on the iron frame net when working.

Furthermore, the supporting mechanism comprises a beam frame, a lifting motor in another folding mechanism is hinged on the beam frame, both ends of the beam frame are also hinged to the folding mechanism, and both ends of the beam frame far away from the folding mechanism are hinged with both ends of a second U-shaped frame. The left and right sides of the inner wall of the second U-shaped frame are both hinged with connecting rods, the other end of the connecting rods is hinged to the fixing element, and the two fixing elements are fixedly connected to the left and right sides of the inner wall of the bed frame, respectively. The first cross beam is provided with a hinging element, and the hinging element is hinged with one end of the first U-shaped frame.

By adopting the technical scheme, the handle can control the rotation of the second U-shaped frame to achieve a better folding effect on the ultra-thin bed, and the connecting rod can rotate without affecting the position adjustment of the second U-shaped frame.

Furthermore, the supporting leg comprises a plurality of supporting columns, a gasket is provided between every two of the supporting columns, and the gasket is provided with an inner ring and an outer ring which assist the supporting columns to be screwed and installed.

By adopting the above technical scheme, when the supporting legs are worn after long-term use, the purpose of replacement can be achieved.

Furthermore, the inner wall of the bed frame is uniformly and fixedly connected with a plurality of baffles.

By adopting the above technical scheme, the baffle is provided, which can support the first U-shaped frame and the second U-shaped frame, so that the iron frame net can be effectively supported.

Furthermore, the motor movable base comprises a movable plate, the movable plate is provided with a notch, one end of the lifting motor is hinged to the notch, both sides of the movable plate are hinged with positioning plates, and the positioning plates are fixedly connected to the struts.

By adopting the above technical scheme, the motor movable base is used to cooperate with the operation of the lifting motor.

To sum up, the present disclosure has the following beneficial effects.

1. In this scheme, after the ultra-thin bed is folded, the lifting motor retracts into the accommodating groove through the motor movable base. After the two bed frames are folded, the motor retracts inward, so that the motor moves on the ground of the bed frame and is attached to the bed frame. A vibration mechanism is provided, and the vibrator can achieve a more stable vibration effect on the iron frame net when working under the action of the wrapping of a sponge sleeve. At the same time, an installing rubber box can fix the sponge sleeve and the vibrator and protect the sponge sleeve and the vibrator well. At the same time, the installing rubber box can be conveniently installed on the ultra-thin bed under the action of an installing iron sheet.
2. A folding mechanism is provided. When the lifting motor works, the cross beam and the second U-shaped frame can be lifted, so that the angles of the cross beam and the second U-shaped frame can be effectively changed, which not only can achieve the folding effect, but also can change the lying posture of people, thus greatly facilitating the use of people. At the same time, under the action of the connecting rod, the fixing element and the handle, the handle can control the rotation of the second U-shaped frame to achieve a better folding effect on the ultra-thin bed, and the connecting rod can rotate without affecting the position adjustment of the second U-shaped frame.
3. A gasket of the supporting leg is provided, preventing the clamping between the supporting legs during installation. Because the gasket can play a better connecting role in the supporting legs, the installation of the supporting leg is facilitated and the installation efficiency is improved.

Figure 1:
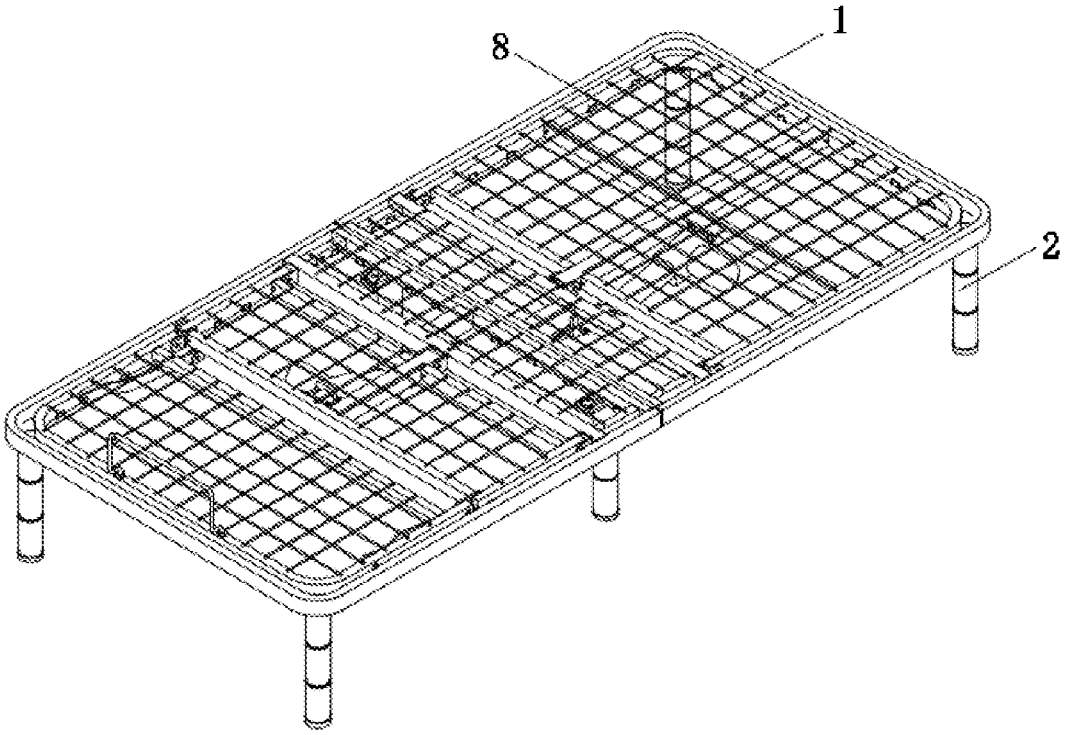
FIG. 1 is a schematic structural diagram of the present disclosure.
Figure 2:
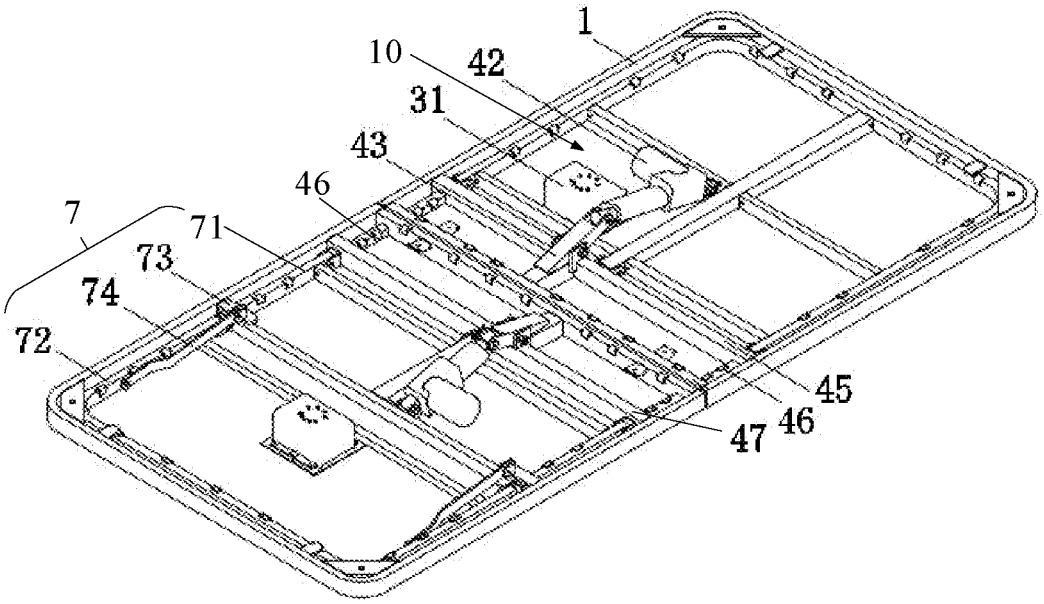
FIG. 2 is a schematic diagram of the three-dimensional structure of a folding mechanism and a supporting mechanism according to the present disclosure.

1. Bed frame; 2. Supporting legs; 21. Supporting column; 22. Gasket; 3. Vibration mechanism; 31. Installing rubber box; 32. Installing iron sheet; 4. Folding mechanism; 41. Fixing element; 42. Lifting motor; 43. Motor movable base; 44. Hinging element; 45. First cross beam; 46. Connecting rod; 47. Second cross beam; 5. Cross beam; 6. First U-shaped frame; 7. Supporting mechanism; 71. Beam frame; 72. Second U-shaped frame; 73. Fixing element; 74. Connecting rod; 75. Handle; 8. Iron frame net; 9. Baffle.

DETAILED DESCRIPTION OF THE EMBODIMENTS

Embodiment

Referring to FIGS. 1-4, the present disclosure provides a technical scheme: a foldable ultra-thin bed, comprising bed frames 1, wherein the number of bed frames 1 is two, the two bed frames 1 are provided in front and back, the left and right sides of the lower surface of the bed frame 1 are fixedly connected with supporting legs 2, a folding mechanism 4 is provided in the bed frame 1, one end of the folding mechanism 4 is fixedly connected to a cross beam 5 which is fixedly connected in a first U-shaped frame 6, both ends of the first U-shaped frame 6 are hinged to the folding mechanism 4, the folding mechanism 4 is further provided with a supporting mechanism 7, and the supporting mechanism 7, the folding mechanism 4 and the first U-shaped frame 6 are all covered with iron frame nets 8. The inner wall of the bed frame 1 is fixedly connected with a plurality of baffles 9.

In this embodiment, the baffle 9 is provided, and the baffle 9 can support the first U-shaped frame 6 and the second U-shaped frame 72, so that the iron frame net 8 can be effectively supported and people can use it normally.

Figure 4:
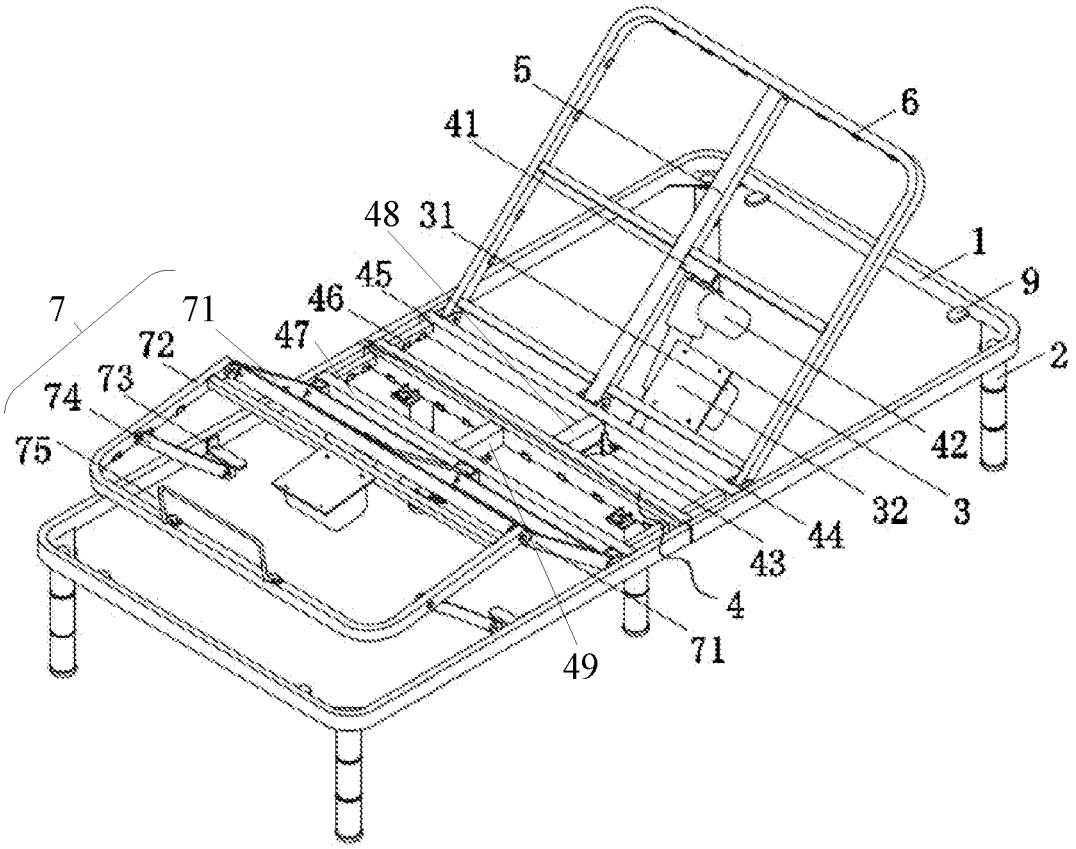
FIG. 4 is a schematic diagram of a modified three-dimensional structure according to the present disclosure.

As shown in FIG. 4, the folding mechanism 4 comprises a first cross beam 45 and a second cross beam 47 which are fixedly connected in the bed frame 1, the first cross beam 45 and the second cross beam 47 are fixedly connected through two connecting rods 46, the two connecting rods 46 are fixedly connected to the left and right sides of the inner wall of the bed frame 1, respectively, the first cross beam 45 is provided with a hinging element 44, and the hinging element 44 is hinged with one end of the first U-shaped frame 6. The first cross beam 45 is fixedly connected to one of the bed frames 1 through a first strut 48 and the second cross beam 47 is fixedly connected to another of the bed frames 1 through a second strut 49, the folding mechanism 4 is further connected with a lifting motor 42, one end of the lifting motor 42 is hinged with a motor movable base 43, the motor movable base 43 is fixedly connected to a corresponding one of the first strut 48 and the second strut 49, each of the two bed frames 1 is provided with a motor movable base, respectively, one end of the lifting motor 42 is hinged with the motor movable base, an accommodating groove 10 for accommodating the lifting motor 42 is provided in the bed frame 1, and when the lifting motor 42 is completely placed in the accommodating groove 10, the motor movable base is attached to the iron frame net 8 in parallel.

In this embodiment, when the lifting motor 42 works, the cross beam 5 and the second U-shaped frame 72 can be lifted, so that the angles of the cross beam 5 and the second U-shaped frame 72 can be effectively changed, which not only can achieve the folding effect, but also can change the lying posture of people, thus greatly facilitating the use of people. At the same time, under the action of the connecting rod, the fixing element 73 and the handle 75, the handle 75 can control the rotation of the second U-shaped frame 72 to achieve a better folding effect on the ultra-thin bed, and the connecting rod can rotate without affecting the position adjustment of the second U-shaped frame 72.

As shown in FIG. 4, the first U-shaped frame 6 is fixedly connected with a reinforcing bar, a vibration mechanism 3 is provided on the reinforcing bar, the vibration mechanism 3 comprises an installing iron sheet 32, the installing iron sheet 32 is fixedly installed at the lower side of the iron frame net 8 by bolts, the lower surface of the installing iron sheet 32 is fixedly connected with an installing rubber box 31, a sponge sleeve is fixedly connected in the installing rubber box 31, and a vibrator is sleeved in the sponge sleeve.

In this embodiment, the vibrator can achieve a more stable vibration effect on the iron frame net 8 when working under the action of the wrapping of a sponge sleeve. At the same time, an installing rubber box 31 can fix the sponge sleeve and the vibrator and protect the sponge sleeve and the vibrator well. At the same time, the installing rubber box 31 can be conveniently installed on the ultra-thin bed under the action of an installing iron sheet 32.

The supporting mechanism 7 comprises a beam frame 71, a lifting motor 42 in another folding mechanism 4 is hinged on the beam frame 71, both ends of the beam frame 71 are also hinged to the folding mechanism 4, and both ends of the beam frame 71 far away from the folding mechanism 4 are hinged with both ends of a second U-shaped frame 72. The left and right sides of the inner wall of the second U-shaped frame 72 are both hinged with connecting rods, the other end of the connecting rods is hinged to the fixing element 73, and the two fixing elements 73 are fixedly connected to the left and right sides of the inner wall of the bed frame 1, respectively.

Figure 3:
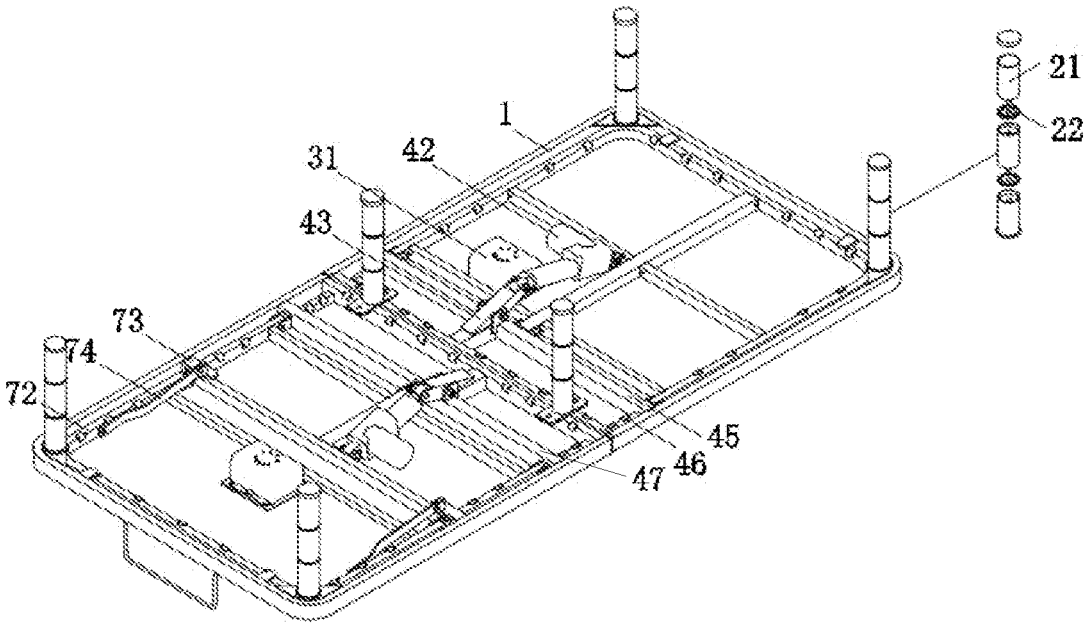
FIG. 3 is a schematic bottom view of the structure according to the present disclosure.

As shown in FIG. 3, the supporting leg 2 comprises a plurality of supporting columns 21, a gasket 22 is provided between every two of the supporting columns 21, and the gasket 22 is provided with an inner ring and an outer ring which assist the supporting columns 21 to be screwed and installed.

Working principle: when the lifting motor 42 works, the cross beam 5 and the second U-shaped frame 72 can be lifted, so that the angles of the cross beam 5 and the second U-shaped frame 72 can be effectively changed, which not only can achieve the folding effect, but also can change the lying posture of people, thus greatly facilitating the use of people. Moreover, the handle 75 can control the rotation of the second U-shaped frame 72 to achieve a better folding effect on the ultra-thin bed. When people lie on the ultra-thin bed, they can control the vibrator to work. The vibrator can achieve a more stable vibration effect on the iron frame net 8 when working under the action of the wrapping of a sponge sleeve.

The specific embodiment is only an explanation of the present disclosure, rather than limit the present disclosure. After reading this specification, those skilled in the art can make changes to the embodiment without creative contribution as required, which are protected by the patent law as long as they fall within the scope of the claims of the present disclosure.

What is claimed is:

1. A foldable ultra-thin bed, comprising bed frames (1), wherein the number of bed frames (1) is two, the two bed frames (1) are provided in a front and a back, a left side and a right side of a lower surface of the bed frames (1) are fixedly connected with supporting legs (2), two folding mechanisms (4) are provided in the bed frames (1), one end of a first folding mechanism of the two folding mechanisms (4) is fixedly connected to a cruciform beam (5) which is fixedly connected in a first U-shaped frame (6), both ends of the first U-shaped frame (6) are hinged to the first folding mechanism, a second folding mechanism of the two folding mechanisms (4) is connected with a supporting mechanism (7), and the supporting mechanism (7), the two folding mechanisms (4) and the first U-shaped frame (6) are all covered with iron frame nets (8), wherein an inner wall of the bed frames (1) is fixedly connected with a plurality of baffles (9) configured to support the first U-shaped frame (6) and the supporting mechanism (7) in the bed frames (1), the first folding mechanism comprise a first cross beam (45) pivotably connected with the first U-shaped frame (6) and the second folding mechanism comprises a second cross beam (47) pivotably connected with the supporting mechanism (7), the first cross beam (45) is fixedly connected to one of the bed frames (1) through a first strut (48) and the second cross beam (47) is fixedly connected to another of the bed frames (1) through a second strut (49), the two folding mechanisms (4) are further comprises two lifting motors (42), one end of each lifting motor (42) is hinged with a motor movable base (43), the other end of one of the lifting motors (42) is fixedly connected with the cruciform beam (5), the other end of the other of the lifting motors (42) is fixedly connected with the supporting mechanism (7), each motor movable base (43) is pivotably connected to a corresponding one of the first strut (48) and the second strut (49);

wherein an accommodating groove for accommodating each lifting motor (42) is provided in the bed frames (1); wherein each motor movable base (43) comprises a movable plate, the movable plate is provided with a notch, one end of a corresponding one of the two lifting motors (42) is hinged to the notch, both sides of the movable plate are hinged with positioning plates, and the positioning plates are fixedly connected to a corresponding one of the struts.

2. The foldable ultra-thin bed according to claim 1, wherein each of the first cross beam (45) and the second cross beam (47) is fixedly connected in the bed frames through two connecting rods (46), the two connecting rods (46) are fixedly connected to a left side and a right side of the inner wall of the bed frames (1), respectively, the first cross beam (45) is provided with a hinging element (44), and the hinging element (44) is hinged with one end of the first U-shaped frame (6).

3. The foldable ultra-thin bed according to claim 1, wherein the first U-shaped frame (6) is fixedly connected with a reinforcing bar, the iron frame nets are provided on the reinforcing bar, a vibration mechanism (3) is provided on the iron frame net, the vibration mechanism (3) comprises an installing iron sheet (32), the installing iron sheet (32) is fixedly installed at a lower side of the iron frame nets (8), a lower surface of the installing iron sheet (32) is fixedly connected with an installing rubber box (31), a sponge sleeve is fixedly connected in the installing rubber box (31), and a vibrator is sleeved in the sponge sleeve.

4. The foldable ultra-thin bed according to claim 2, wherein the supporting mechanism (7) comprises a beam frame (71), the second folding mechanism is provided on the beam frame (71), both ends of the beam frame (71) are hinged to the second folding mechanism, and both ends of the beam frame away from the second folding mechanism are hinged with a second U-shaped frame.

5. The foldable ultra-thin bed according to claim 4, wherein a left and a right sides of an inner wall of the second U-shaped frame (72) are provided with one end of two connecting rods, respectively, the other end of the two connecting rods is hinged to two fixing elements (73), respectively, and the two fixing elements (73) are fixedly connected to the left side and the right side of the inner wall of the bed frames (1), respectively.

6. The foldable ultra-thin bed according to claim 1, wherein each of the supporting legs (2) comprises a plurality of supporting columns (21), a gasket (22) is provided between every two of the supporting columns (21), and the gasket (22) is provided with an inner ring and an outer ring which allow the supporting columns (21) to be screwed and installed.

* * * * *